US011952685B2

(12) United States Patent
Izawa

(10) Patent No.: US 11,952,685 B2
(45) Date of Patent: Apr. 9, 2024

(54) TOWEL CLOTH

(71) Applicant: IZAWA TOWEL CO., LTD., Tokyo (JP)

(72) Inventor: Shoji Izawa, Tokyo (JP)

(73) Assignee: IZAWA TOWEL CO., LTD., Tokyo (JP)

( * ) Notice: Subject to any disclaimer, the term of this patent is extended or adjusted under 35 U.S.C. 154(b) by 0 days.

(21) Appl. No.: 17/917,142

(22) PCT Filed: Dec. 14, 2021

(86) PCT No.: PCT/JP2021/045927
§ 371 (c)(1),
(2) Date: Oct. 5, 2022

(87) PCT Pub. No.: WO2022/138305
PCT Pub. Date: Jun. 30, 2022

(65) Prior Publication Data

US 2023/0374708 A1 Nov. 23, 2023

(30) Foreign Application Priority Data

Dec. 23, 2020 (JP) ..... 2020-213226

(51) Int. Cl.
*D03D 27/08* (2006.01)
*D02G 3/04* (2006.01)
(Continued)

(52) U.S. Cl.
CPC ..... *D03D 27/08* (2013.01); *D02G 3/045* (2013.01); *D02G 3/44* (2013.01); *D03D 15/217* (2021.01);
(Continued)

(58) Field of Classification Search
CPC .... D03D 27/08; D03D 15/217; D03D 15/283; D03D 15/292; D03D 15/47;
(Continued)

(56) References Cited

U.S. PATENT DOCUMENTS 5,763,040 A * 6/1998 Murphy ..... D06M 15/267 442/84
6,109,015 A * 8/2000 Roark ..... D01D 5/16 57/286
(Continued)

FOREIGN PATENT DOCUMENTS

JP S 63288211 A 11/1988
JP H 07097745 A 4/1995
(Continued)

OTHER PUBLICATIONS

International Search Report of the International Searching Authority directed to related International Patent Application No. PCT/JP2021/045927, dated Mar. 1, 2022; 2 pages.

*Primary Examiner* — Robert H Muromoto, Jr.
(74) *Attorney, Agent, or Firm* — Sterne, Kessler, Goldstein & Fox P.L.L.C.

(57) ABSTRACT

Towel cloth is provided, which has bulky and fluffy hand, of which hand hardly changes and fluff drop hardly occurs during washing, of which a dewatering property is favorable and dries rapidly after washing, and which also has water absorbability. Towel cloth in which a pile yarn is locked to a ground yarn, wherein the pile yarn is constituted by a twisted union yarn of a non-crimpable polyester-based multifilament yarn and a vegetable fiber.

4 Claims, 6 Drawing Sheets

(51) Int. Cl.

| | |
|---|---|
| ***D02G 3/44*** | (2006.01) |
| ***D03D 15/217*** | (2021.01) |
| ***D03D 15/283*** | (2021.01) |
| ***D03D 15/292*** | (2021.01) |
| ***D03D 15/47*** | (2021.01) |
| *D03D 15/00* | (2021.01) |

(52) U.S. Cl.
CPC ..... *D03D 15/283* (2021.01); *D03D 15/292* (2021.01); *D03D 15/47* (2021.01); *D10B 2201/02* (2013.01); *D10B 2331/04* (2013.01); *D10B 2401/02* (2013.01); *D10B 2503/00* (2013.01)

(58) Field of Classification Search
CPC .... D03D 1/0017; D03D 15/37; D03D 15/567; D02G 3/045; D02G 3/44; D02G 3/34; D02G 3/36; D10B 2201/02; D10B 2331/04; D10B 2401/02; D10B 2503/00; D10B 2201/01; D10B 2401/14; A47K 10/02
See application file for complete search history.

(56) References Cited

U.S. PATENT DOCUMENTS

| | | | | |
|---|---|---|---|---|
| 11,732,384 | B2 * | 8/2023 | Williams | B29B 7/485 525/437 |
| 2002/0071951 | A1 | 6/2002 | Hernandez et al. | |
| 2003/0186021 | A1 * | 10/2003 | Tanaka | A44B 18/0034 428/92 |
| 2020/0040491 | A1 * | 2/2020 | Mittal | D03D 27/08 |
| 2020/0325601 | A1 * | 10/2020 | Masuda | D02G 3/34 |
| 2023/0203723 | A1 * | 6/2023 | Izawa | D03D 27/08 139/396 |

FOREIGN PATENT DOCUMENTS

| | | | | | |
|---|---|---|---|---|---|
| JP | 2002105786 | A | * | 4/2002 | D04H 1/42 |
| JP | 2002155449 | A | | 5/2002 | |
| JP | 2003155636 | A | | 5/2003 | |
| JP | 2004353153 | A | * | 12/2004 | D04H 1/42 |
| JP | 2006077338 | A | | 3/2006 | |
| JP | 2006257560 | A | | 9/2006 | |
| JP | 2011144493 | A | | 7/2011 | |
| JP | 2013177708 | A | | 9/2013 | |
| JP | 2017141539 | A | | 8/2017 | |

* cited by examiner

TOWEL CLOTH

TECHNICAL FIELD

The present invention relates to towel cloth.

BACKGROUND ART

In recent years, there have been increasing demands from consumers for greater hand variations and higher functionality in towels. Hand of a towel has a problem in that, while the towel provides a soft and fluffy feel in an initial stage of use, the towel becomes increasingly hard and loses the initial texture thereof over repeated washing. There is also a problem in that fluff drop during the process of washing and adheres to other laundry as well as a problem in that fluff having come off during washing adheres to skin when sweating or after a hot bath and gives a sense of discomfort to a user. Furthermore, a towel with poor dewatering property has many problems including drying extremely slowly after washing and causing significant electric energy loss.

While solutions to such problems include a method of blending a synthetic fiber made of a hydrophobic material with cotton as represented by a towel created by blending polyester spun yarn with cotton, the reality is that, although the method undeniably improves dimensional stability and the like during washing, the method also causes fluff drop and pilling (pills) attributable to spun yarn to occur and does not provide a fundamental solution.

In addition, in consideration of the problems described above, there is a manufacturing method of a staple fiber, a yarn, and a cloth in which polytrimethylene terephthalate (hereinafter, abbreviated as PTT) is used in place of polyester staple fiber (Patent Document 1). Furthermore, regarding a polyester filament (long fiber), there is a core yarn which combines a bimetal type composite fiber of a polyester multifilament yarn with cotton, the polyester multifilament yarn being created by respectively bonding PTT and polyethylene terephthalate (hereinafter, abbreviated as PET) in semicircular shapes to each other (Patent Document 2). In addition, there is a twisted union yarn combines a core yarn mentioned above and cotton spun yarn (Patent Document 3). Furthermore, there is a stretched woven shirt fabric of a twisted union yarn combines core yarn mentioned above and cotton spun yarn (Patent Document 4). Moreover, a stretched woven fabric in which a vegetable fiber is mixed with a core spun yarn mentioned above (Patent Document 5).

However, since Patent Document 1 presents a spun yarn of PTT of which fluff drop and uprightness of fluff described earlier are high, pilling (pills) is likely to occur and no improvement can be made. Patent Documents 2 to 5 all present a bimetal type composite fiber of a polyester multifilament yarn created by respectively bonding PTT and PET in semicircular shapes to each other which, when heated during weaving of a fabric, the PTT side contracts significantly to create a spiral crimp, in turn producing a stretchable yarn and woven fabric. When the conjugated fiber is used in a pile yarn of towel cloth, since large crimps are created to make a shape of the pile yarn uneven and a surface of the towel cloth irregular, smooth hand and a pleasing surface cannot be produced and the problems cannot be solved.

As described above, none of the Patent Documents solve the problems presented above and, consequently, under the present circumstances, none of the Patent Documents explicitly describe towel cloth of which a pilling property is not an issue, which has balanced pile yarn, which has bulky and fluffy hand, of which hand hardly changes and drop fluff hardly occurs during washing, of which a dewatering property is high and dries rapidly after washing, and which also has water absorbability.

CITATION LIST

Patent Document

Patent Document 1: Patent Publication JP-A-2011-144493

Patent Document 2: Patent Publication JP-A-2017-141539

Patent Document 3: Patent Publication JP-A-2003-155636

Patent Document 4: Patent Publication JP-A-2006-77338

Patent Document 5: Patent Publication JP-A-2002-155449

SUMMARY

Technical Problem

An object of the present invention is to provide towel cloth which solves the problems described above and which has bulky and fluffy hand, of which hand hardly changes and drop fluff hardly occurs during washing, of which a dewatering property is favorable and dries rapidly after washing, and which also has water absorbability.

Solution to Problem

In order to solve the problems described above, an aspect of towel cloth according to the present invention is towel cloth in which a pile yarn is locked to a ground yarn, wherein the pile yarn is constituted by a twisted union yarn combines at least a non-crimpable polyester-based multifilament yarn and a vegetable fiber.

Preferably, a single filament fineness of the multifilament yarn is 0.1 to 10.0 decitex.

Preferably, the multifilament yarn is a conjugate fiber including at least polytrimethylene terephthalate.

Preferably, the composite fiber is a fiber in which polytrimethylene terephthalate and polyethylene terephthalate are concentrically combined in a lengthwise direction of a yarn.

Preferably, in the twisted union yarn, a mixing ratio of the multifilament yarn and the vegetable fiber is 1:9 to 9:1.

Preferably, the vegetable fiber is cotton.

Advantageous Effects of Invention

According to the present invention, by making a non-crimpable polyester-based multifilament yarn and a vegetable fiber into a twisted union yarn and using the twisted union yarn in towel cloth, the problems described above can be solved and towel cloth imparted with high functionality can be provided which has bulky and fluffy hand, of which hand hardly changes and drop fluff hardly occurs during washing, of which a dewatering property is favorable and dries rapidly after washing, and which also has water absorbability.

BRIEF DESCRIPTION OF DRAWINGS

FIG. 2(*b*) shows an example of a sectional view of an eight-part division conjugate fiber among the non-crimping polyester-based multifilament composite fiber shown in FIG. 1.

FIG. 2(*c*) shows an example of a sectional view of a polymer conjugate fiber among the non-crimping polyester-based multifilament composite fiber shown in FIG. 1.

FIG. 3(*b*) shows a cross-sectional photograph according to a first comparative example of a pile definition of a towel.

DESCRIPTION OF EMBODIMENTS

Figure 1:
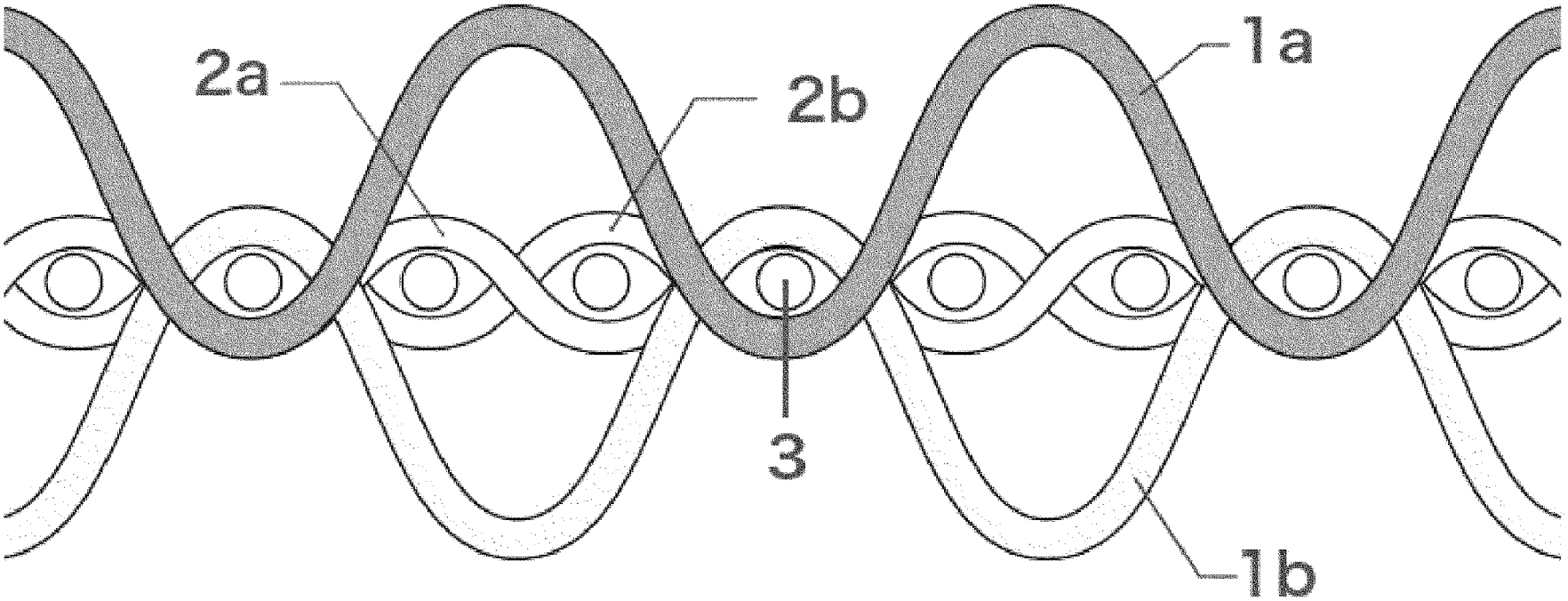
FIG. 1 is a structural diagram of towel cloth used in the present embodiment.

FIG. 1 is a structural diagram of toweling used in the present embodiment. In the drawing, reference sign 1*a* denotes a pile yarn on a front of a towel cloth and reference sign 1*b* denotes a pile yarn on a rear of the towel cloth. Reference signs 2*a* and 2*b* denote two ground yarns being warp yarns that lock the pile yarns and reference sign 3 denotes a ground yarn being a weft yarn. The pile yarns 1*a* and 1*b* according to the embodiment shown in FIG. 1 which protrude significantly to the front and the rear of the towel cloth are important yarns that determine a quality of hand.

Figure 2A:
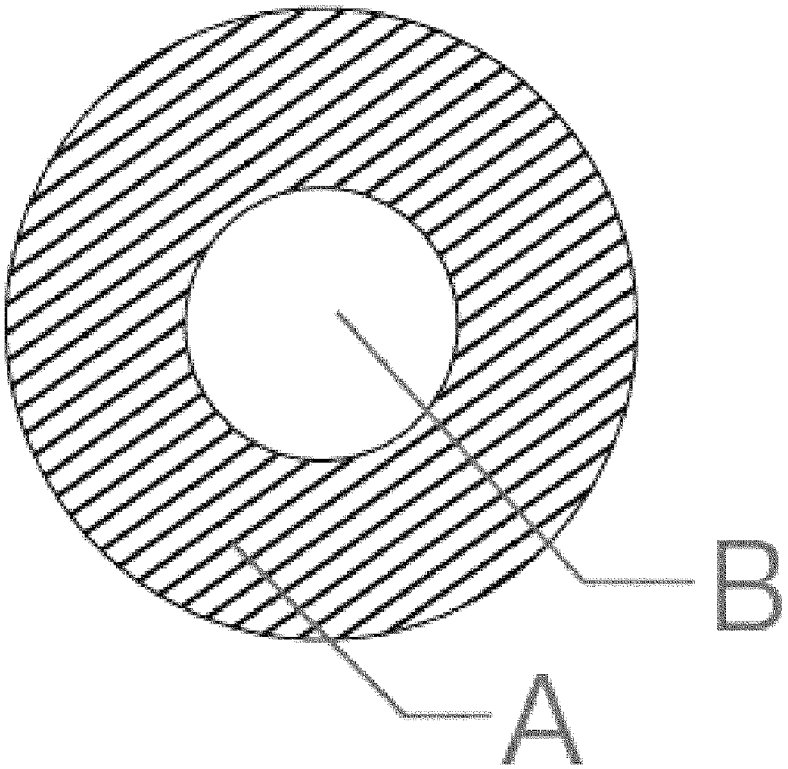
FIG. 2(*a*) shows an example of a sectional view of a concentric conjugate fiber among a non-crimping polyester-based multifilament composite fiber shown in FIG. 1.
Figure 2B:
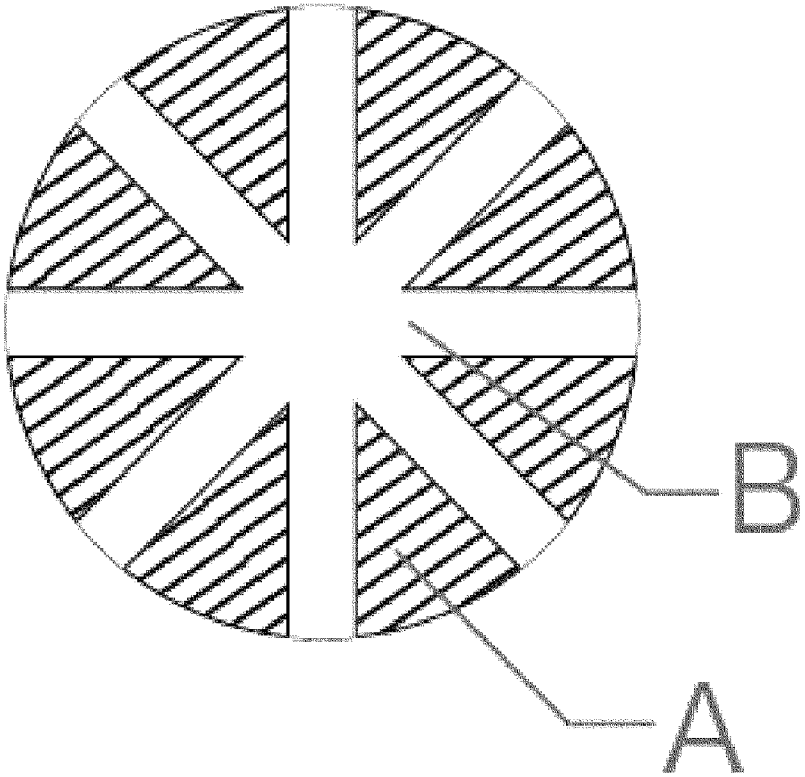
Figure 2C:
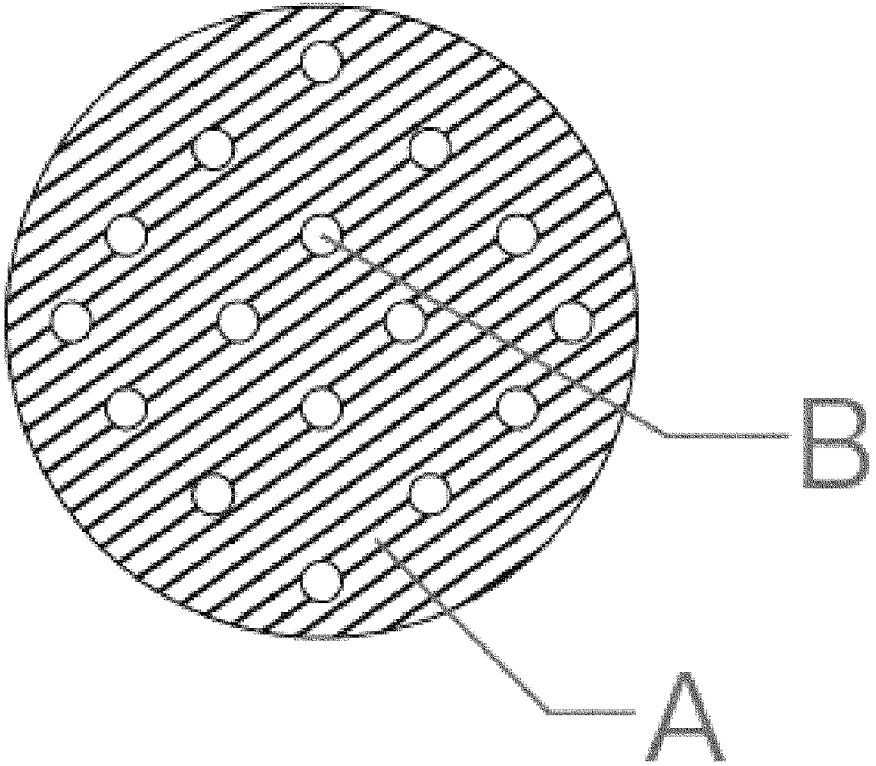

FIG. 2 is an example of a sectional view of a non-crimping polyester-based multifilament conjugate fiber to be preferably used in the embodiment shown in FIG. 1. FIG. 2(*a*) presents a concentric conjugate fiber, FIG. 2(*b*) presents an eight-part division conjugate fiber, and FIG. 2(*c*) presents a polymer blend conjugate fiber. Each of an A component and a B component is a conjugate fiber to which any one polymer of polytrimethylene terephthalate (PTT), polyethylene terephthalate (PET), and polybutylene terephthalate (PBT) is joined (with the exception of combinations in which the A component and the B component are the same).

Figure 3A:
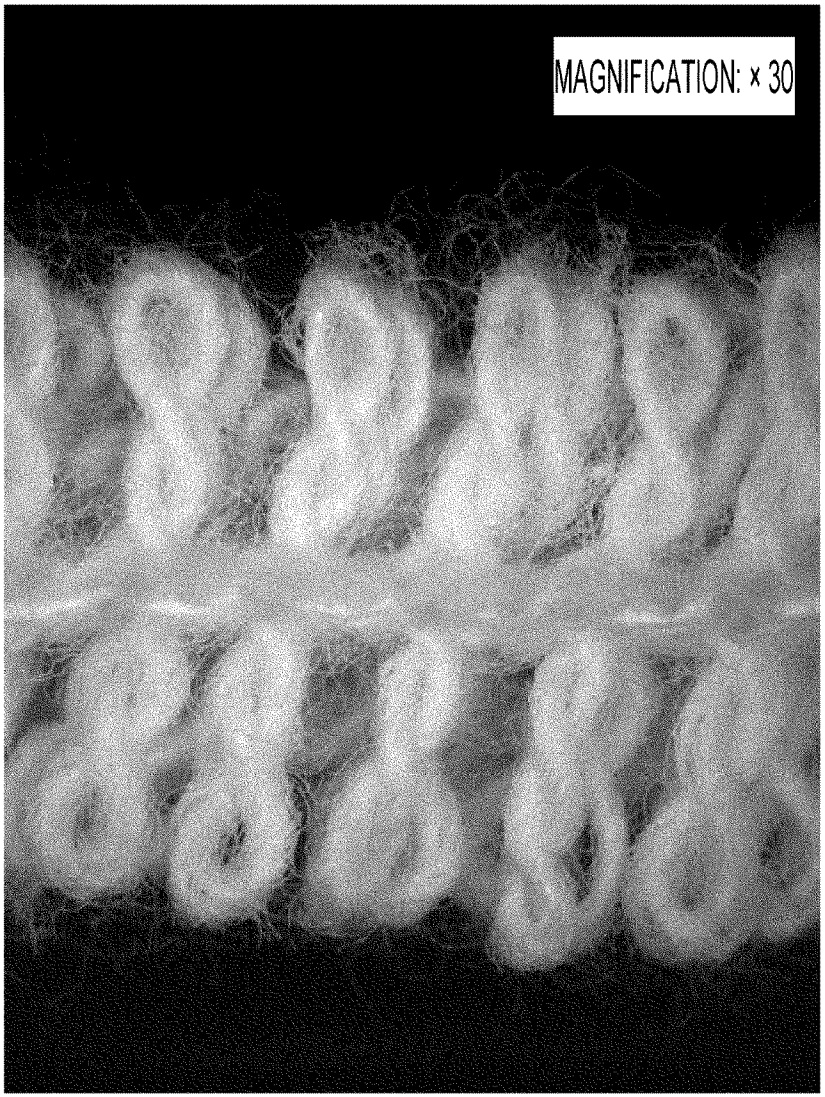
FIG. 3(*a*) shows a cross-sectional photograph according to a first example of a pile definition of a towel according to the embodiment shown in FIG. 1.
Figure 3B:
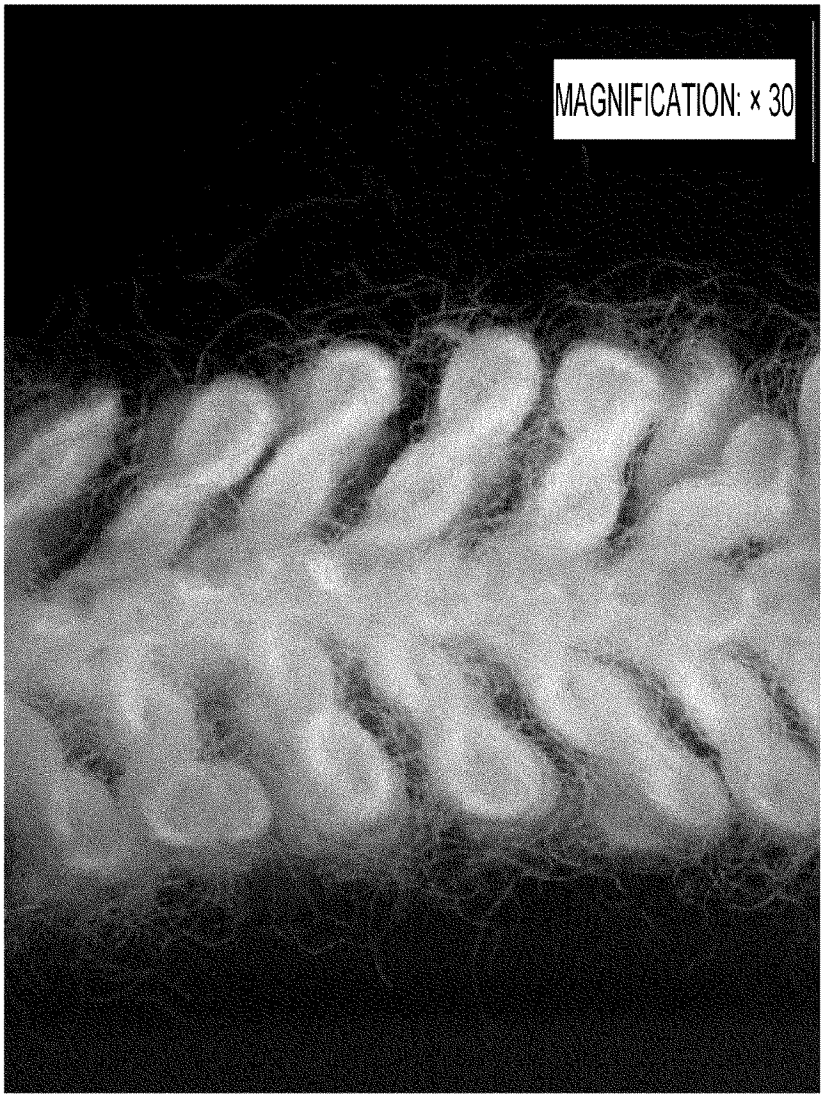

FIG. 3 shows cross-sectional photographs of a pile definition of a towel. FIG. 3(*a*) presents a first example and FIG. 3(*b*) presents a first comparative example.

Details of the present embodiment will be described. Towel cloth according to the present embodiment twists a non-crimpable polyester-based multifilament yarn union with a vegetable fiber and uses the twisted union yarn as at least a pile yarn. The towel cloth according to the present embodiment also includes cases where twisted union yarn is used as a ground yarn. The multifilament yarn is a so-called drawn yarn (grey yarn) in which a crimp does not occur. The drawn yarn is defined as a yarn of which a hot water shrinkage factor (boiling water shrinkage factor) according to 9.24.3C method specified in JIS L 1095: 2010 is 13% or lower and in which a crimp is not created by the hot-water treatment. Since the drawn yarn has a shrinkage factor of 13% or lower due to processing heat of a towel process and a crimp is not created, the vegetable fiber to be twisted union can be reliably reinforced and a good pile definition and bulky hand can be obtained. In addition, hand hardly changes due to washing and is therefore preferable. Furthermore, since the pile yarn does not become twisted, a surface of the towel cloth is balanced and is therefore preferable.

Specifically, the polyester-based multifilament yarn is PTT, PET, or PBT and, more specifically, an independent yarn drawn from each polymer and a multifilament yarn (long fiber) of a conjugate fiber which combines the respective polymers. In this case, in addition to a regular type, PET includes copolymerized PETs such as cationic dye-dyeable polyester created by copolymerizing a sulfone group and easily dyeable polyester created by copolymerizing polyethylene glycol.

A single filament fineness of the multifilament yarn according to the present embodiment is a fineness (decitex) of a single filament of one filament yarn extruded from a single hole of a spinneret. For example, in the case of a 36-filament yarn of which a total fineness is 84 decitex, the fineness of a single filament is 2.3 decitex. The smaller the single filament fineness, the softer the hand, and the larger the single filament fineness, the harder the hand.

In the present embodiment, since favorable hand of towel cloth which is soft but firm can be obtained, the fineness of the single filament is preferably 0.1 to 10.0 decitex. Furthermore, 0.3 to 7.0 decitex is particularly preferable. Single filament fineness under 0.1 decitex means that the yarn is excessively thin and results in worn-out hand, and single filament fineness exceeding 10.0 decitex means that the yarn is too hard and are therefore both not preferable.

Specifically, first, when an independent yarn (for example, a 100% PTT yarn, a 100% PET yarn, or a 100% PBT yarn) twisted uniion with a vegetable fiber to be made into a towel, since the yarn itself is soft in the case of PTT and appropriate softness and repulsion can be produced, PTT can be preferably applied. In this case, yarn with a single filament fineness of 1 to 7 decitex is favorably used. In the case of PET which is slightly hard, thin yarn with a single filament fineness of 0.3 to 4 decitex is preferably used, and in the case of PBT which produces soft and moist hand, yarn with intermediate fineness of which a single filament fineness is 2 to 8 decitex is preferably used.

Furthermore, in place of the independent yarns described above, twisting union a polyester-based composite fiber as shown in FIG. 2 with a vegetable fiber produces hand with even higher texture and is therefore preferable. In FIG. 2, while the A component and the B component may be a conjugate fiber to which a polymer of any of PTT, PET, and PBT is joined, the concentric conjugate fiber shown in FIG. 2(*a*) of which a sheath component (A component) is PTT and a core component (B component) is PET is particularly preferable. By arranging soft PTT in the sheath and slightly harder PET in the core, the conjugate fiber produces hand with a soft surface and significant repulsion and, at the same time, since PTT being the sheath component is superior in chromogenic property as compared to PET, a vivid and deep color can be produced. In consideration of the hand and the chromogenic property described above, a yarn of which a composition ratio of the A component is 40 to 80 wt. % and of which a single filament fineness of the composite fiber is 0.4 to 8.0 decitex can be preferably applied. FIG. 2(*b*) presents an eight-part division conjugate fiber capable of producing soft but slightly firm hand and is therefore preferable. FIG. 2(*c*) presents a polymer blend conjugate fiber of the A component and the B component which produces hand that is a mixture of softness and hardness and of which dye affinity is high as a whole and therefore preferable.

Next, while a method of twisting union the multifilament yarn with vegetable fiber is not particularly limited, preferably, a sliver (roving yarn) of the vegetable fiber and the filament yarn are twisted union in the spinning process to make a single yarn. The obtained single yarn has high yarn strength and low fluff drop and produces a pleasing surface and soft and flexible hand of towel cloth and is therefore preferable.

Furthermore, as a twisting union method, a core yarn type in which a filament yarn is used as a core and a vegetable fiber covers the core as a sheath is particularly preferable. Since a yarn of this type has a surface with a texture of cotton and uses a filament core, firm and preferable hand is produced.

When making a two ply yarn, two twisted union yarns may be paralleled or, for example, a single yarn of a conventional ring spun yarn may be doubled and twisted with a single yarn of the twisted union yarn, and means of making a two ply yarn is to be appropriately selected in accordance with an object of hand, external appearance, or the like of towel cloth.

While the number of twists of the twisted union yarn is not particularly limited, a yarn with a small number of twists produces towel cloth which has soft hand but which is slightly more likely to drop fluff. In addition, as the number of twists increases, fluff drop tends to decrease but hand tends to become harder. Examples of a preferable number of twists which satisfies both hand and fluff drop include 550 to 1100 times/m for a 30-count single yarn (30/1), 400 to 900 times/m for a 16-count single yarn (16/1), and 320 to 630 times/m for a 10-count single yarn (10/1).

While a mixing ratio of a pile yarn of twisted union yarn is not particularly limited, based on a relationship between water absorbability of cotton and a drying rate after washing of towel cloth, a mixing ratio of a filament yarn when used as a pile yarn preferably ranges from 10 to 70%. A mixing ratio lower than 10% results in a low drying speed after washing and a mixing ratio exceeding 70% causes water absorbability of cotton to decline and are therefore not preferable.

In addition, a mixing ratio of the filament yarn and the vegetable fiber of towel cloth as a whole is preferably 1:9 to 9:1 from the perspectives of hand of cotton, water absorbability, and drying speed after washing. In particular, a mixing ratio of 2 to 6:8 to 4 is preferable. A mixing ratio of the filament yarn of lower than 1 results in a low drying speed after washing and a mixing ratio of the filament yarn exceeding 9 results in inferior hand of cotton and water absorbability and are therefore not preferable.

While a yarn count of twisted union yarn is not particularly limited, a thin single yarn with a yarn count of 100 to 40 (100/1-40/1) can be preferably applied to thin towel cloth, a single yarn with a yarn count of 30 to 16 (30/1-16/1) can be preferably applied to medium thick towel cloth, and a thick single yarn with a yarn count of 12 to 8 (12/1-8/1) can be preferably applied to thick towel cloth. Therefore, accordingly, preferable towel cloth with a desired thickness is produced by respectively twisting union with a vegetable fiber, total fineness of multifilament yarn in twisted union yarn is 10 to 30 decitex in the case of thin towel cloth, 40 to 150 decitex in the case of medium thick towel cloth, and 150 to 800 decitex in the case of thick towel cloth.

In addition, the vegetable fiber in the twisted union yarn as referred to in the present embodiment is preferably cotton from the perspectives of hand, water absorbability, moisture absorbency, and handleability as a towel, and 100% cotton is particularly preferable. It should be noted that a small amount of a hemp, rayon, cupra, or wool material may be blended with cotton. Blending rayon or cupra provides moisture absorbency and blending wool provides heat retention.

Next, the twisted union yarn is used to weave towel cloth. In this case, in consideration of effects of the hand and the drying speed after washing described above, the twisted union yarn is particularly preferably at least used as the pile yarn. Using the twisted union yarn as both the pile yarn and the ground yarn further increases the drying speed after washing. Using the twisted union yarn as only the ground yarn provides a fabric with firmer hand. In this manner, the fabric is designed and woven by appropriately changing how the twisted union yarn is used in accordance with required characteristics.

Next, in line with processing steps of cotton, the woven grey fabric is scoured, bleached, and finished (off-white finish). When dyeing is to be performed, after scouring and bleaching, a polyester side is dyed by a disperse dye and, subsequently, a cotton side is dyed by a reactive dye. In the case of cationic dye-dyeable PET, the fabric is dyed by a cationic dye and then finished. In dyeing, in addition to plain dyeing in which the polyester side and the cotton side are dyed in a same color, dyes can be selectively used to achieve multicolor dyeing or chambray (shading). Furthermore, print processing can also be performed on the scoured and bleached fabric, and in any case, the present embodiment enables a wide variety of colors to be commoditized.

Examples of a favorable weight of fabric which better exhibits an advantageous effect of the present embodiment include a weight of 100 to 250 g/m$^2$ for thin fabric, a weight of 250 to 500 g/m$^2$ for medium thick fabric, and a weight of 500 to 1000 g/m$^2$ for thick fabric. A fabric with a weight under 100 g/m$^2$ is thin and insufficient in terms of bulkiness and a fabric with a weight exceeding 1000 g/m$^2$ is too thick and too heavy and are therefore both not preferable.

EXAMPLES

While the present embodiment will be hereinafter explained in detail based on examples, it is to be understood that the present embodiment is not necessarily limited to the examples.

Measurement Method

1. Measurement of Hot Water Shrinkage Factor of Polyester-Based Multifilament Yarn Hot water shrinkage factor (boiling water shrinkage factor) of yarn in accordance with 9.24.3C method specified in JIS L 1095: 2010 was measured. To summarize the test, a prescribed initial load was applied to yarn and a 500-mm mark was affixed, the yarn was processed in boiling water for 10 minutes, and the yarn was subsequently dewatered using filter paper and then air-dried. After air drying, a length of the initial mark on the yarn having been affixed under the prescribed initial load was measured and a hot water shrinkage factor was obtained using the following equation. 10 tests were performed and an average value thereof was adopted as the hot water shrinkage factor. A yarn of which the shrinkage factor of 13% is lower and which is devoid of crimp can be applied to the present embodiment.

$$\text{Hot water shrinkage factor (\%)} = (\text{length of yarn prior to hot-water treatment } (L0)) - (\text{length of yarn after hot-water treatment } (L1))/(\text{length of yarn prior to hot-water treatment } (L0)) \times 100$$

2. Evaluation of Hand of Towel Cloth (1) Pile Uprightness

Erectility (contact angle) of pile yarn was photographed at 30 power by a microscope (manufactured by KEYENCE CORPORATION) in a weft yarn cross-sectional photograph of towel cloth. As a measurement of the contact angle, an angle (an angle up to 90°) at which a pile yarn rises from the right or left from a horizontal plane of a ground yarn of the photographed towel was measured and the measured angle was defined as the contact angle. The contact angle was measured at 20 locations and an average value thereof was obtained. The closer the contact angle is to 90°, the better the pile uprightness, the greater the thickness, the bulkier and fluffier the hand, which is favorable. FIG. 3(*a*) presents a first example and FIG. 3(*b*) presents a photograph of a first comparative example.

(2) Bulkiness

Bulkiness was evaluated based on bulkiness ($cm^3/g$) according to the following equation which is expressed as a volume per 1 gram of a woven towel fabric. The larger the value, the bulkier and, therefore, the more favorable. Thickness was measured according to the method described in JIS L-1096 and a 1-m square was accurately weighted as the weight.

$$\text{Bulkiness } (cm^3/g) = \text{thickness } (mm)/\text{weight } (g/m^2) \times 1000$$

(3) Evaluation of Fluffy Hand

Using compression tester KES-FB3-A (manufactured by KATO TECH CO., LTD.), towel cloth was compressed at a constant speed to obtain a compression workload (WC) ($gf \cdot cm^2$) thereof. Measurements were taken at five locations and the WC value is expressed as an average value thereof. The WC value indicates (energy) when fabric is compressed and the higher the value, the more readily the towel is compressed and the greater a bulge and fluffy feel.

(4) Change in Hand Due to Washing

Towel cloth was washed 20 times using a washing machine in accordance with the method described in JIS L-0217, 103. In addition, drying after washing was performed by hanging the towel cloth out to dry inside a room with an air conditioner. Drying conditions were as follows: temperature 20° C., humidity 65%, and air volume 12,8 $m^3$/min. After drying, compression workload WC ($gf \cdot cm^2$) was measured at five locations and the WC value was expressed as an average value thereof. The larger the WC value after drying, the fluffier the hand and therefore preferable and, at the same time, the smaller a difference in WC values between before and after washing, the smaller a decline in fluffy hand due to washing and therefore favorable.

3. Evaluation of Fluff Drop Property of Towel Cloth (1) Fluff Drop Property Due to Washing of Towel Cloth Fluff drop due to washing is measured according to the method described in JIS L 2017, 103.

A fluff drop rate (%) was obtained according to the following equation, where the smaller the value, the smaller the amount of fluff drop and therefore favorable.

$$\text{Fluff drop rate } (\%) = (\text{weight of dropped fluff after washing } (g1)/(\text{weight of towel before washing } (g0)) \times 100$$

(2) Evaluation of Fluff Loss by Cellophane Tape of Towel Cloth

Fluff loss by cellophane tape was evaluated according to a fluff adhesion test method of the QTEC test method (QTEC-NTM1). To summarize the test, cellophane tape was attached to a lower part of a 4.0-Kpa heavy bob (weight), and an adhesive surface of the tape was brought into contact with a front surface of the towel cloth for a duration of 5 seconds. The tape was then peeled off from the towel cloth and a lack or abundance of fluff (fluff loss) being adhered to the tape was visually determined using the following five grades: grade 5 (no fluff loss, superior), grade 4 (minimal fluff loss, favorable), grade 3 (normal fluff loss), grade 2 (fluff loss present, poor), grade 1 (lot of fluff loss, inferior).

4. Evaluation of Dewatering Property of Towel Cloth (1) Residual Moisture Percentage Weight of a 20 cm-square of towel cloth was accurately measured and immersed in water for 20 minutes. Subsequently, the wet towel cloth was taken out of the water, subjected to centrifugal dewatering for four minutes in a dewatering bin of a washing machine, a weight of the dewatered towel cloth was accurately measured, and a residual moisture percentage (%) of the towel cloth was obtained according to the following equation. The smaller the value, the more favorable the dewatering property. There is a tendency that, the better the dewatering property, the higher a subsequent drying speed.

$$\text{Residual moisture percentage } (\%) \text{ of fabric} = (\text{weight of fabric after being immersed in water and then dewatered } (W1)) - (\text{weight of fabric before being immersed in water } (W0))/(\text{weight of fabric before being immersed in water } (W0)) \times 100$$

5. Evaluation of Quick-Drying Property After Washing of Towel Cloth (1) Drying Time After Washing Towel cloth after being immersed in water and then dewatered was dried by hanging the towel cloth out to dry inside a room with an air conditioner. Drying conditions were: temperature 20° C., humidity 65%, and air volume 12.8 $m^3$/min, and the weight of the fabric was measured every 20 minutes. Drying time (minutes) when the residual moisture percentage of the fabric reached 30% (dryness factor reached 70%) and drying time (minutes) when the residual moisture percentage of the fabric reached 10% (dryness factor reached 90%) were respectively measured. The shorter the time, the quicker the drying and therefore favorable.

6. Evaluation of Water Absorbability of Towel Cloth (1) Speed of Water Absorption A measurement of a speed of water absorption by towel cloth was evaluated based on a dripping method; burette method specified in JIS L 1907. To summarize the test, a drop of water was dripped to the towel cloth from a height of 10 cm and an absorption time (seconds) until a mirror surface of the water drop disappeared was measured. The shorter the time, the more favorable the water absorbability.

First Example (1) Manufacturing Method and Evaluation Method of Towel Cloth

A. Twisted Union Yarn

As a polyester-based multifilament yarn, the yarn shown in FIG. 2(*a*) in which the A component PTT and the B component PET are fibers concentrically combined in a length direction of the yarn at a composition ratio of A component 70%: B component 30% was used. It was confirmed that a drawn yarn (grey yarn) with a total fineness of 84 decitex, 48 filaments, and a single filament fineness of 1.75 decitex had a hot water shrinkage factor of 7.8% and that no crimp was produced by the hot-water treatment.

Next, the filament yarn was twisted union with a cotton sliver (roving yarn) and a 16-count single yarn (16/1) of a core yarn-type twisted union yarn with a core of polyester and a sheath of cotton was obtained. A blend ratio of the yarn was polyester 23%: cotton 73%, the number of twists was 600 times/m, and the twist direction was a Z-twist.

B. Weaving, Processing, and Finishing of Towel Cloth

The 16-count single yarn (16/1) of the twisted union yarn was used as a pile yarn and a 16-count 100% cotton single yarn (16/1) was respectively used as two warp ground yarns and one weft ground yarn to weave a towel. A pile length was 10 mm and a mixing ratio of the pile yarn was polyester 23%: cotton 77%. In addition, a mixing ratio of the towel cloth as a whole was polyester 16%: cotton 84%.

Next, in line with processing steps of cotton, the grey fabric was scoured in a 95° C. alkaline bath, bleached with hydrogen peroxide, set with a tenter at 150° C., and finished (off-white finish). Thickness of the finished towel cloth was 3.53 mm and weight was 422 g/m$^2$. In addition, an evaluation result of a photographed image (FIG. 3(*a*)) of a state of pile uprightness is described in Table 1.

Second Example

As a twisted union yarn, a drawn yarn (grey yarn) of an independent PET yarn of polyester-based multifilament with a total fineness of 66 decitex, 48 filaments, and a single filament fineness of 1.38 decitex was used. It was confirmed that a hot water shrinkage factor of the drawn yarn was 5.1% and the yarn was devoid of crimp caused by the hot water shrinkage. The yarn was twisted union with cotton to produce a 30-count single yarn (30/1) of a core yarn-type twisted union yarn with a core of the filament described above and a sheath of cotton. The number of twists was 840 times/m and the twist direction was a Z-twist. Two yarns of the same single yarn were further folded to create a 30-count two ply yarn (30/2). Otherwise, in accordance with the first example, the yarn was used as a pile yarn to weave towel cloth which was then scoured, bleached, set, and finished. A mixing ratio of the pile yarn was polyester 17%: cotton 83% and a mixing ratio of the towel cloth as a whole was polyester 12%: cotton 88%. In addition, thickness of the finished towel cloth was 3.34 mm and weight was 411 g/m$^2$. An evaluation was performed in accordance with the first example of which a result is described in Table 1.

First Comparative Example

With the exception of using a 16-count single yarn (16/1) of ring spun cotton as a pile yarn, the yarn was used to weave towel cloth which was then scoured, bleached, set, and finished in accordance with the first example. A mixing ratio of the towel cloth as a whole was cotton 100%. In addition, thickness of the finished towel cloth was 3.02 mm and weight was 426 g/m$^2$. In addition, a photograph of a state of pile uprightness was taken (FIG. 3(*b*)). Another evaluation result of the finished towel cloth is described in Table 1.

(2) Evaluation Result (3) Evaluation Result

As is apparent from Table 1, the towel cloth according to the first example is a superb, bleached, off-white towel cloth with good pile uprightness, which has bulky and fluffy hand, of which hand hardly changes and fluff drop hardly occurs during washing, of which a dewatering property is favorable and dries rapidly after washing, and which also has water absorbability. Specifically, as shown in the cross-sectional photograph in FIG. 3(*a*), a contact angle of the pile yarn was 85° and the pile uprightness was excellent (58° in the first comparative example). In addition, bulkiness was 8.36 cm$^3$/g which is 18% higher than the first comparative example. Furthermore, compression workload increased by 34% to produce fluffy hand and a decline in hand after washing 20 times was minimal. Moreover, fluff drop caused by washing decreased to approximately ¼ while fluff loss according to the cellophane tape method was grade 4 and therefore superior. In addition, residual moisture percentage of the fabric after washing/dewatering was 50%, indicating good dewatering property. Furthermore, with respect to a drying speed after washing, the towel cloth dried 3.0 times faster at a time point where the dryness factor was 70% and 1.5 times faster at a time point where the dryness factor was 90%. Moreover, water absorbability was less than 1 second and therefore superior.

The finished towel was woven into a hand towel and a practical trial was performed. The bulky and fluffy hand was pleasant and a decline in hand was not perceptible even after washing. In addition, there was hardly any fluff drop of the towel when washed and fluff was not readily transferred to other clothes such as sweaters. Furthermore, the hand towel dried quickly after washing and had water absorbability, making the hand towel extremely useful and comfortable.

On the other hand, the first comparative example was inferior to the first example in terms of pile uprightness and hand and, particularly, the hand was hard after washing. In addition, the fact that fluff drop and fluff loss occur frequently, dewatering property is poor, and drying after washing is slow results in mediocre towel cloth.

The second example was equivalent to the first example in terms of bulkiness, fluffy hand, fluff drop property, and water absorbability and only slightly inferior with respect to dewatering property and drying rate but was extremely superior in all evaluated items as compared to the first comparative example.

Third Example

The twisted union yarn was used in weaving as a weft ground yarn in addition to a pile yarn (pile yarn and weft

TABLE 1

| | Bulkiness (cm$^3$/g) | Compression workload WC (gf · cm$^2$) (1) Raw fabric (2) After washing 20 times | Fluff drop property (2) Washing method (%) (2) Cellophane tape method (grade) | Dewatering property Residual moisture percentage (%) | Drying time after washing (minutes) (1) When 70% dry (2) When 90% dry | Speed of water absorption (seconds) |
|---|---|---|---|---|---|---|
| First example | 8.36 | (1) 3.94<br>(2) 3.78 | (1) 0.026<br>(2) 4 | 50.1 | (1) 65<br>(2) 159 | Under 1 |
| Second example | 8.13 | (1) 3.81<br>(2) 3.90 | (1) 0.028<br>(2) 4 | 59.0 | (1) 73<br>(2) 190 | Under 1 |
| First comparative example | 7.09 | (1) 2.93<br>(2) 2.54 | (1) 0.098<br>(2) 2 | 90.3 | (1) 192<br>(2) 240 | Under 1 |

ground yarn: 16-count single yarn (16/1) of twisted union yarn, two warp ground yarns: 16-count cotton single yarn (16/1)). Next, with the exception of dyeing the woven towel cloth after scouring and bleaching, the towel cloth was finished in accordance with the first example. The dyeing involved dyeing a polyester side with a blue disperse dye for 45 minutes at 130° C. and then plain-dyeing a cotton side with a blue reactive dye for 40 minutes at 80° C., setting with a tenter at 150° C., and finishing. A mixing ratio of the towel cloth as a whole was polyester 18.5%: cotton 81.5%. In addition, thickness of the finished towel cloth was 3.41 mm, weight was 422 g/m$^2$, and bulkiness was 8.03 cm$^3$/g. The finished product had good pile uprightness, high bulkiness at 8.03 cm$^3$/g, fluffy hand, and a decline of hand was extremely small even after washing 20 times. Furthermore, fluff drop during washing and adhesion of fluff to other clothing were minimal. In particular, a drying speed after washing enabled the towel cloth to be 70% dry after 55 minutes and 90% dry after 134 minutes, resulting in an extremely quickly-drying blue towel cloth.

As described above, the present embodiment produces towel cloth not obtainable by conventional art and which has bulky and fluffy hand, of which hand hardly changes and fluff drop hardly occurs during washing, of which a dewatering property is favorable and dries rapidly after washing, and which also has water absorbability.

First Aspect

Towel cloth in which a pile yarn is locked to a ground yarn, wherein the pile yarn is constituted by at least a twisted union yarn of a non-crimpable polyester-based multifilament yarn and a vegetable fiber.

Second Aspect

The towel cloth according to the first aspect, wherein a single filament fineness of the multifilament yarn is 0.1 to 10.0 decitex.

Third Aspect

The towel cloth according to the first or second aspect, wherein the multifilament yarn is a composite fiber including at least polytrimethylene terephthalate.

Fourth Aspect

The towel cloth according to the third aspect, wherein the conjugated fiber is a fiber in which polytrimethylene terephthalate and polyethylene terephthalate are concentrically combined in a lengthwise direction of a yarn.

Fifth Aspect

The towel cloth according to any one of first to fourth aspects, wherein in twisted union yarn, a mixing ratio of the multifilament yarn and the vegetable fiber is 1:9 to 9:1.

Sixth Aspect

The towel cloth according to any one of first to fifth aspects, wherein the vegetable fiber is cotton.

REFERENCE SIGNS LIST

1*a* Pile yarn on front side of fabric
1*b* Pile yarn on rear side of fabric
2*a*, 2*b* Warp ground yarn
3 Weft ground yarn
A Sheath component
B Core component

What is claimed is:

1. Towel cloth in which a pile yarn is locked to a ground yarn, wherein:

the pile yarn has a core yarn type twisted union yarn with a non-crimpable polyester-based multifilament yarn core and a vegetable fiber sheath that covers the core;

the multifilament yarn has a hot water shrinkage factor of 13% or lower; and wherein the multifilament yarn is a core-in-sheath fiber in which polytrimethylene terephthalate constituting a sheath portion and polyethylene terephthalate constituting a core portion are concentrically combined in a lengthwise direction of a yarn.

2. The towel cloth according to claim 1, wherein a single filament fineness of the multifilament yarn is 0.1 to 10.0 decitex.

3. The towel cloth according to claim 1, wherein in the twisted union yarn, a mixing ratio of the multifilament yarn and the vegetable fiber is 1:9 to 9:1.

4. The towel cloth according to claim 1, wherein the vegetable fiber is cotton.

* * * * *